US005822820A

United States Patent [19]

Heisler

[11] Patent Number: 5,822,820

[45] Date of Patent: Oct. 20, 1998

[54] APPARATUS FOR CLEANING A COMPUTER MOUSEBALL

[76] Inventor: Glenna Heisler, 1926 Fruit St., Santa Ana, Calif. 92701

[21] Appl. No.: 915,392

[22] Filed: Aug. 20, 1997

[51] Int. Cl.[6] ..... A46B 11/00

[52] U.S. Cl. ..... 15/21.2; 15/104.92

[58] Field of Search ..... 15/104.92, 21.2, 15/88.1, 160, 97.1

[56] References Cited

U.S. PATENT DOCUMENTS

| | | | |
|---|---|---|---|
| D. 247,451 | 3/1978 | Sapier | D34/5 |
| 2,617,132 | 11/1952 | Goller | 15/21.2 |
| 2,807,037 | 9/1957 | Garske | 15/21.2 |
| 2,822,558 | 2/1958 | Vandervort et al. | 15/21.2 |
| 3,044,089 | 7/1962 | Boynton | 15/21.2 |
| 3,304,659 | 2/1967 | Eichhorn | 15/21.2 |
| 3,583,016 | 6/1971 | McConnell | 15/97 |
| 3,678,526 | 7/1972 | Burkholder | 15/97 |
| 3,748,676 | 7/1973 | Warren et al. | 15/21.2 |
| 4,750,232 | 6/1988 | Doney | 15/104.92 |
| 4,760,618 | 8/1988 | Chapin, Jr. | 15/104.93 |
| 4,945,596 | 8/1990 | Chang et al. | 15/21.2 |
| 4,958,396 | 9/1990 | Butler et al. | 15/21.2 |
| 4,965,906 | 10/1990 | Mauro | 15/104.92 |
| 5,555,586 | 9/1996 | Dorrich et al. | 15/104.92 |
| 5,572,761 | 11/1996 | Meyer | 15/104.92 |
| 5,638,567 | 6/1997 | Danyluk | 15/104.92 |
| 5,647,082 | 7/1997 | Gorske et al. | 15/104.92 |

*Primary Examiner*—Gary K. Graham
*Attorney, Agent, or Firm*—Goldstein & Canino

[57] ABSTRACT

The invention is an apparatus for cleaning a computer mouseball. The mouseball washer has a container which houses a bristle assembly and a solvent. A plunger holds the mouseball and is adapted to fit within the interior of the container. The plunger is manipulated into the container where the mouseball comes in contact with the bristle assembly and solvent. This provides a simple and efficient method of removing any foreign substance accumulated on the mouseball.

3 Claims, 3 Drawing Sheets

APPARATUS FOR CLEANING A COMPUTER MOUSEBALL

BACKGROUND OF THE INVENTION

The invention relates to an apparatus for cleaning a computer mouse. More particularly this invention relates to an apparatus for efficiently cleaning a computer mouseball.

With the increased reliance and use of computers in the world today, there is a definite need for an effective way to clean and maintain the computer mouse. The mouse is an essential input device between the user and the computer and it is critical that it be maintained to achieve optimal performance. The conventional manner of cleaning a mouse is to remove the ball and clean the components with a cotton swab dipped in a solvent such as alcohol. This process has proved to be both tedious and inefficient and further demonstrates the need for the current invention.

U.S. Pat. No. 4,760,618 relates to an apparatus for cleaning the interior of a mouse. The reference addresses the cleaning of the interior chamber of the mouse but does not discuss cleaning the mouseball which is the most important component. The reference also leaves the high probability that when applying the solvent it will spill or splash onto the operator or the nearby computer equipment where it can cause damage or injury.

U.S. Pat. No. 4,945,596 relates to a golf ball, golf club and golf shoe scrubber but is specifically designed for golf balls and equipment.

While these units may be suitable for the particular purpose employed, or for general use, they would not be as suitable for the purposes of the present invention as disclosed hereafter.

SUMMARY OF THE INVENTION

It is an object of the invention to produce a new and improved method and apparatus for cleaning a computer mouse ball resulting in improved efficiency and longer useful life of the computer mouse.

It is another object of the invention to provide a safe, hazard free method of cleaning the mouse by housing the solvent in a leakproof and spillproof container.

A further object of the invention is to provide a simple operation for cleaning a mouseball.

It is still a further object of the invention to provide an apparatus for cleaning a mouseball which is inexpensive, long lasting and reliable in operation.

The invention is an apparatus for cleaning a computer mouseball. The mouseball washer has a container which houses a bristle assembly and a solvent. A plunger holds the mouseball and is adapted to fit within the interior of the container. The plunger is manipulated into the container where the mouseball comes in contact with the bristle assembly and solvent. This provides a simple and efficient method of removing any foreign substance accumulated on the mouseball.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1A:
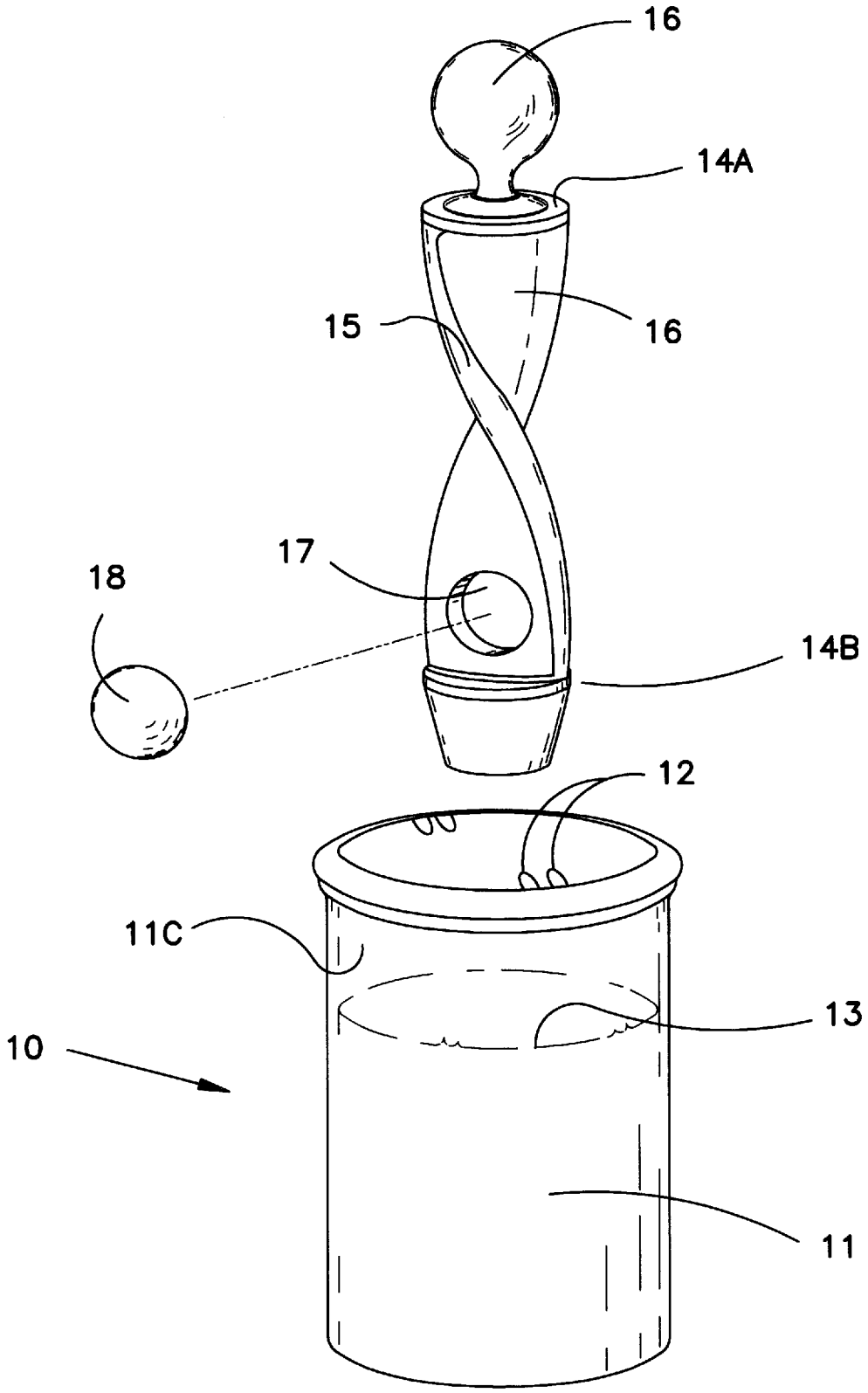
FIG. 1A is a diagrammatic view of a computer mouseball washer in a primary position ready to have a mouseball placed into a plunger.

FIG. 1A illustrates a mouseball washer 10 having a container 11 cylindrical in shape with an open top 11A, a closed bottom 11B, an inner wall 11C and two pairs of opposing appenditures 13 extending inwardly from the open top 11A of the container 11. The container is adapted to hold a solvent 12 such as detergent. An elongated plunger 14 having a top end 14A and an opposite bottom end 14B is adapted to fit within the container 11. The plunger 14 has curved edges 15 which fit between the appenditures 12 to provide rotation of the plunger 14 when it is moved downward into the container 11. Another means for rotating the plunger may be used. A means for manipulating the plunger 14 from a primary position outside the container 11 to a secondary position within the container 11 is provided. This means can be a handle 16 attached to the top end of the plunger 14A for manual manipulation or a motor device. The plunger 14 has an aperture 17 at the bottom end of the plunger 14, the aperture 17 being of sufficient size to hold a mouseball 18 in place yet allowing the mouseball 18 to freely rotate within the aperture 17 on it's descent into the container 11.

Figure 1B:
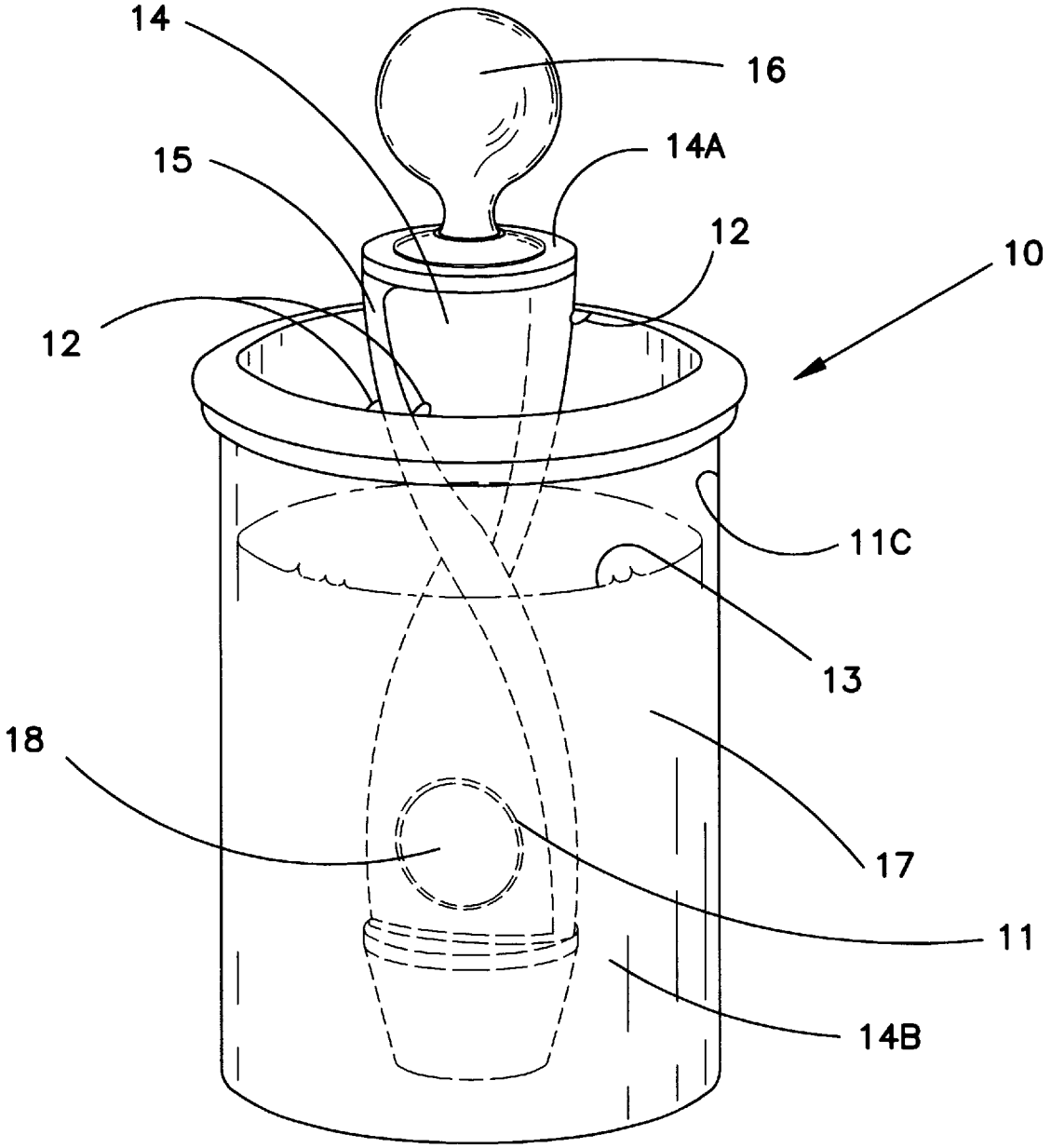
FIG. 1B is a diagrammatic view of the computer mouseball washer in a secondary position with the mouseball in place in the plunger and emersed into a container housing an interior brush assembly and solvent.
Figure 2:
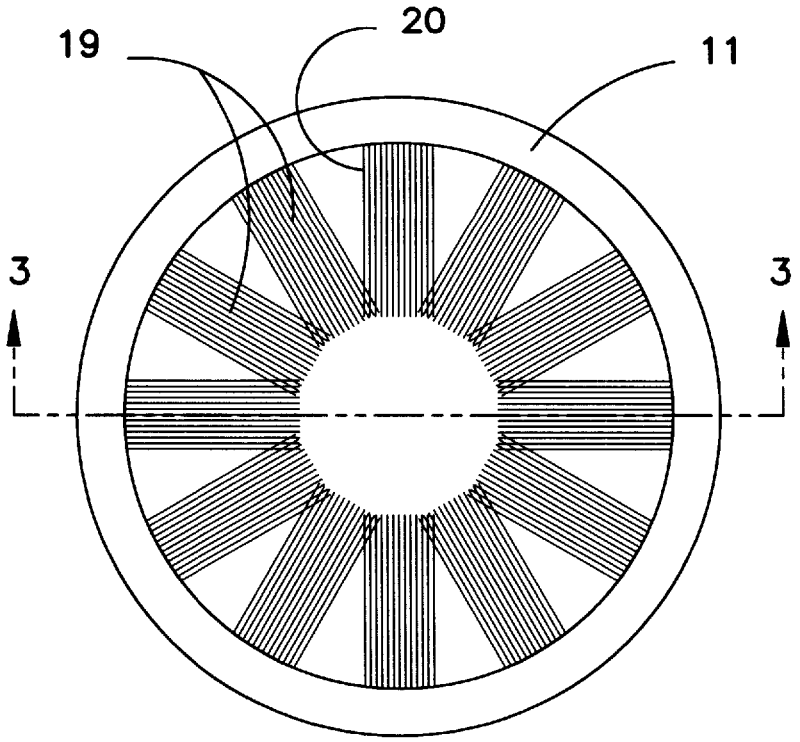
FIG. 2 is a top plan view of the container displaying the positioning and layout of the brush assembly.

FIG. 1B illustrates the mouseball washer 10 in the secondary position with the mouseball 18 descended into the container 11. FIG. 2 illustrates a top plan view of the container 11 with a brush assembly 19. The brush assembly has a plurality of inner bristles 20 which extend radially from the inner wall of the container 11C and extend toward the center of the container 11 at sufficient length to come into contact with the mouseball 18 when it is emersed into the container 11. The inner bristles 20 are of a sufficient number and length to come into contact with the entire diameter of the mouseball 18.

Figure 3:
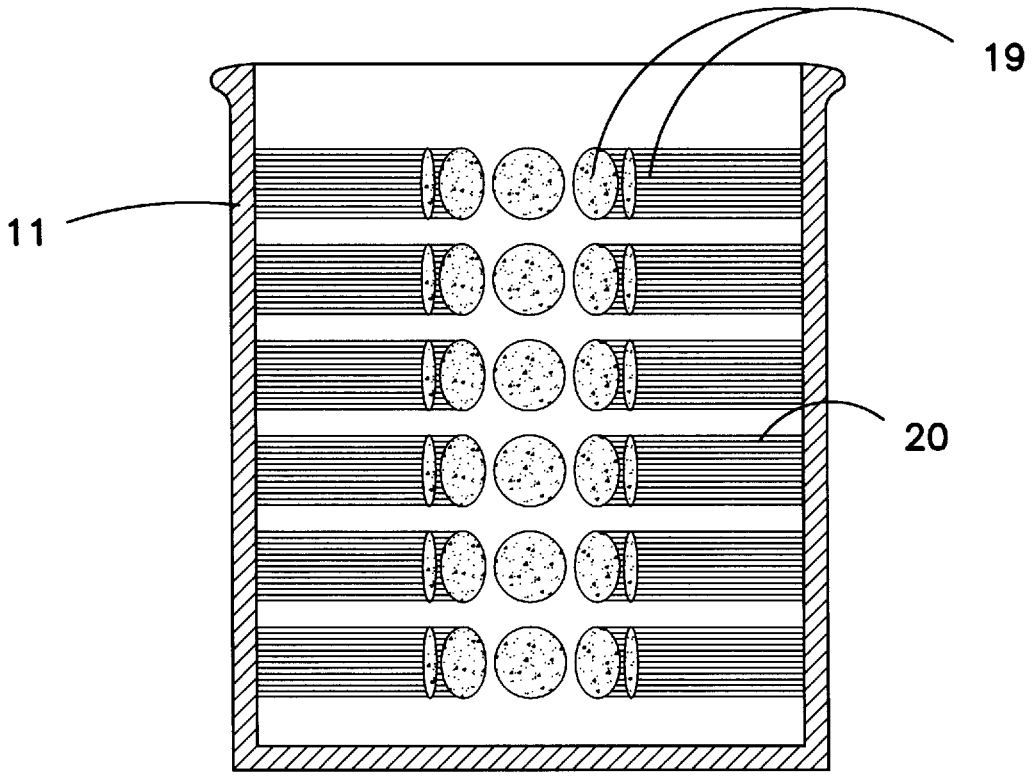
FIG. 3 is a cross-sectional view of the container taken on line 3—3 of FIG. 2 displaying the positioning and layout of the interior brush assembly.

FIG. 3 illustrates a cross-sectional view of the container 11 and the brush assembly 19 taken on line 3—3 of FIG. 2. The inner bristles 20 extend throughout the entire container 11.

What is claimed is:

1. An apparatus for cleaning a computer mouseball, comprising:

a container, cylindrical in shape with an open top and a closed bottom for holding a solvent;

a plunger adapted to fit within the container, the plunger having an aperture to accept a computer mouseball;

a bristle assembly within the container for cleaning the mouseball when the plunger is within the container;

means for manipulating the plunger from a primary position outside the container to a secondary position within the container for contact between the mouseball, the bristle assembly and the solvent; and means for rotating the plunger when it is moved between the primary and secondary position, comprising two pairs of appenditures extending inwardly from the open top of the container and curved edges on the plunger which fit between the appenditures to provide rotation of the plunger when it is moved within the container.

2. The apparatus as recited in claim 1, wherein the means for manipulating the plunger comprises a handle fixed to the plunger, whereby a user can manually move the mouseball into the container.

3. The apparatus as recited in claim 1 wherein the bristle assembly further comprises:

a plurality of inner bristles extending radially from the inner wall of the container of sufficient number and length to come into contact with the entire diameter of the mouseball.

* * * * *